US005746370A

United States Patent [19]

Stone

[11] Patent Number: 5,746,370

[45] Date of Patent: May 5, 1998

[54] SHAKER POUR SPOUT DISPENSER

[75] Inventor: James L. Stone, Grand Rapid, Mich.

[73] Assignee: Tenneco Packaging Inc., Evanston, Ill.

[21] Appl. No.: 684,977

[22] Filed: Aug. 7, 1996

[51] Int. Cl.[6] ..... B65P 5/54

[52] U.S. Cl. ..... 229/217; 222/565; 229/219; 493/56; 493/80

[58] Field of Search ..... 229/217, 218, 229/219, 240, 242; 222/480, 563, 565; 493/56, 63, 69–72, 79–81

[56] References Cited

U.S. PATENT DOCUMENTS

| | | | |
|---|---|---|---|
| 742,271 | 10/1903 | Allen | 222/565 |
| 939,825 | 11/1909 | Frank | 229/242 |
| 1,367,379 | 2/1921 | Gruenberg | 229/240 |
| 2,166,222 | 7/1939 | Ranko et al. | 222/565 |
| 2,543,084 | 2/1951 | Williamson et al. | 229/242 |
| 2,885,993 | 5/1959 | Phillips . | |
| 2,903,175 | 9/1959 | Peimer . | |
| 3,133,689 | 5/1964 | Rossi . | |
| 3,184,137 | 5/1965 | Mohler . | |
| 3,185,377 | 5/1965 | Moore . | |
| 3,187,977 | 6/1965 | Graybill . | |
| 3,187,978 | 6/1965 | Graybill . | |
| 3,289,913 | 12/1966 | Svensson . | |
| 3,344,972 | 10/1967 | Robinson et al. . | |
| 3,362,612 | 1/1968 | Mohler . | |
| 3,568,910 | 3/1971 | McConnell . | |
| 4,317,518 | 3/1982 | Mode . | |
| 4,809,853 | 3/1989 | Weber . | |
| 4,852,764 | 8/1989 | Stone | 220/315 |
| 4,858,793 | 8/1989 | Stone . | |
| 4,909,395 | 3/1990 | Weissman . | |
| 4,944,406 | 7/1990 | Zehnal . | |
| 4,967,910 | 11/1990 | Schuster . | |
| 5,014,888 | 5/1991 | Bryan . | |
| 5,035,330 | 7/1991 | Kuchenbecker . | |
| 5,169,059 | 12/1992 | Desmond et al. | 229/215 |
| 5,205,480 | 4/1993 | Roccaforte | 229/229 |
| 5,259,552 | 11/1993 | Kuchenbecker | 229/207 |
| 5,333,781 | 8/1994 | Roccaforte | 229/229 |
| 5,429,297 | 7/1995 | Walsh | 229/215 |
| 5,452,850 | 9/1995 | Allsop | 229/219 |
| 5,531,376 | 7/1996 | Brink et al. | 229/215 |
| 5,582,344 | 12/1996 | Lawson et al. | 229/217 |

FOREIGN PATENT DOCUMENTS

| | | | |
|---|---|---|---|
| 606816 | 10/1960 | Canada . | |
| 92953 | 5/1962 | Denmark . | |
| 59251 | 5/1954 | France | 229/240 |
| 3832-544 | 3/1990 | Germany . | |
| 1275802 | 5/1972 | United Kingdom . | |

*Primary Examiner*—Gary E. Elkins
*Attorney, Agent, or Firm*—Arnold, White & Durkee

[57] ABSTRACT

A paperboard container having a reclosable shaker pour spout for dispensing granular products. The reclosable shaker pour spout is formed on a wall of the container from first and second minor flaps which are folded inwardly within the container, a first-down major flap which is folded inwardly and overlies the the first and second minor flaps, and a second-down major flap which is folded inwardly and overlies the first-down major flap. Both of the first and second minor flaps have at least one semi-aperture formed on their outer edges which are aligned with corresponding semi-apertures on the other minor flap. The semi-apertures on each of the flaps cooperate to form full apertures in response to the first and second minor flaps being folded inwardly within the container. A detachable plug formed on the first-down major flap overlies the apertures in response to the first-down major flap being folded inwardly on top of the first and second minor flaps. A tear-away pour spout opening tab formed on the second-down major flap overlies and becomes adhered to the detachable plug in response to the second-down major flap being folded inwardly on top of the first-down major flap. Initial opening of the container is accomplished by tearing away the opening tab from the second-down major flap, which causes the detachable plug to become detached from the first-down major flap and create an opening in its former position, thus providing access to the apertures formed from the first and second minor flaps. The container may thereafter be closed by frictionally engaging the plug into the opening on the first-down major flap.

14 Claims, 5 Drawing Sheets

SHAKER POUR SPOUT DISPENSER

FIELD OF THE INVENTION

The present invention relates generally to the field of paperboard folding containers used to dispense products in granular form and, more particularly, to a paperboard container with a reclosable shaker pour spout in which apertures for dispensing the product are manufactured by die cutting opposing minor flaps of the container.

BACKGROUND OF THE INVENTION

It has long been known that containers may be simply and economically manufactured from a "blank", or flat sheet of paperboard, which is folded and glued to form a completed paperboard container. For those containers intended to store granular products, it is beneficial to provide the top portion of the carton with a pour spout comprised of a plurality of holes or apertures so that a user may dispense the product by inverting and shaking the container. Generally, the size of the apertures are chosen in proportion to the size of the product so that an appropriate amount of product is dispensed in response to the inverting and shaking of the container. It is also advantageous that the pour spout be reclosable so that the product will be insulated within the confines of the container when not being dispensed and so that the product is less likely to be spilled. Both of these features have been provided in the prior art.

However, there are several disadvantages associated with prior art shaker pour spout type paperboard containers relating to the manufacture of the product outlet apertures. For instance, to form the outlet apertures of known prior art designs, a hole punching tool is used to punch down on the surface or surfaces of the blank on which the holes are to be formed. These surfaces typically are one or more of the flaps which will ultimately be folded down to form the top portion of the container. Quite often, apertures are not properly formed by this first step because the punched out portions of the flaps remain frictionally engaged within the punched out holes. Thus, a second step of "stripping" or punching out the holes is required to ensure proper formation of the outlet apertures. This problem becomes more pronounced when the container is used to store fine granular products requiring small outlet apertures. The smaller the aperture, the more difficult it is to punch and strip the holes. A related problem associated with prior art shaker type containers lies in alignment of apertures on multiple flaps. Where apertures are formed on more than one flap, the flaps must be perfectly aligned when being folded on top of each other to ensure that the resulting aperture is the proper size. If the flaps are not perfectly aligned, the resulting aperture will be too small to effectively dispense the product. Similar to the punching and stripping problem discussed above, this problem becomes exacerbated if a small output aperture is desired to dispense fine granular products.

Accordingly, the present invention is directed to providing a shaker type paperboard container that overcomes or at least reduces the effects of one or more of the problems set forth above.

SUMMARY OF THE INVENTION

In accordance with one aspect of the present invention, there is provided a container having a reclosable shaker pour spout for dispensing granular products. The container includes a plurality of side panels hingedly connected along transverse fold lines and folded relative to each other to form a first and second pair of opposing sides of the container. A plurality of bottom flaps are hingedly connected to the bottom edges of the side panels and folded inwardly from the opposing sides to form the bottom of the container. First and second top minor flaps are hingedly connected to top edges of one of the pairs of opposing sides, each having generally linear outer edges with portions cut away therefrom to define at least one semi-aperture on their outer edges. The first and second top minor flaps are folded inwardly so that their outer edges generally meet. The semi-apertures along each of the outer edges are aligned so that they combine to form at least one aperture at the interface between the edges of the first and second top minor flaps. A pair of top major flaps, including a first-down top major flap and a second-down top major flap, are hingedly connected to top edges of the other pair of opposing sides and folded inwardly over the top minor flaps. The surface of the first-down top major flap is punched therethrough to define a detachable die-cut plug. The first-down top major flap is then folded inwardly so that it overlaps the pair of top minor flaps and so that the detachable die-cut plug overlays the aperture(s) formed by the pair of top minor flaps. Two opposing tear lines are formed on the second-down top major flap to define the outer edges of a tear-away pour spout opening tab. The second-down top major flap is then folded inwardly over the first-down top major flap such that a bottom surface of the opening tab is adhered to the detachable die-cut plug. The opening tab is adapted to be lifted from the second-down top major flap. Upon initial opening of the container, lifting of the opening tab causes perforations along the opposing tear lines to break, resulting in the opening tab breaking free from the second-down top major flap along its outer edges while remaining attached to the second-down top major flap along a hinged rear edge. The detachable die-cut plug remains adhered to the bottom surface of the opening tab and becomes detached from the first-down top major flap in response to the initial opening of the container. Thereafter, the container becomes reclosable by means of the detachable plug becoming frictionally engaged within the opening in the first-down top major flap formed by its initial removal.

In accordance with another aspect of the present invention, there is provided a unitary blank of paperboard material adapted to be formed into a container having a reclosable shaker pour spout for dispensing granular products. The blank is comprised of four consecutively joined side panels, a first and fourth of the four side panels having a free outer edge, a second of the four side panels hingedly attached to the first side panel along a first working score line, a third of the four side panels hingedly attached to the second side panel along a pre-break score line, and a fourth of the four side panels hingedly attached to the third side panel along a second working score line. The first and third side panels are of equal width, as are the second and fourth side panels. A glue flap is hingedly attached to the outer edge of the first side panel. A first-down bottom major flap having a length not greater than that of the second and fourth side panels is hingedly connected to a bottom edge of the first side panel. A first-down top major flap having a length not greater than that of the second and fourth side panels is hingedly connected to a top edge of the first side panel. The surface of the first-down top major flap is punched therethrough to define a detachable die-cut plug. A first bottom minor flap having a length less than the width of the first and third side panels is hingedly connected to a bottom edge of the second side panel. A first top minor flap having a length approximately half of the width of the first and the third side panels is hingedly connected to a top edge of the second side panel. The first top minor flap has a generally linear outer edge with portions cut away therefrom to define at least one semi-aperture on the outer edge. A second-down bottom major flap having a length not greater than the width of the second and the fourth side panels is hingedly connected to a bottom edge of the third side panel. A second-down top major flap having a length not greater than the width of the second and the fourth side panels is hingedly connected to a top edge of the third side panel. Two opposing tear lines are formed on the second-down top major flap to define the edges of a tear-away pour spout opening tab. A second bottom minor flap having a length less than the width of the first and the third side panels is hingedly connected to a bottom edge of the fourth side panel. Finally, a second top minor flap having a length approximately half of the width of the first and the third side panels is hingedly connected to a top edge of the fourth side panel. The second top minor flap has a generally linear outer edge with portions cut away therefrom to define at least one semi-aperture on the outer edge.

BRIEF DESCRIPTION OF THE DRAWINGS

The foregoing and other advantages of the invention will become apparent upon reading the following detailed description and upon reference to the drawings in which.

Figure 1:
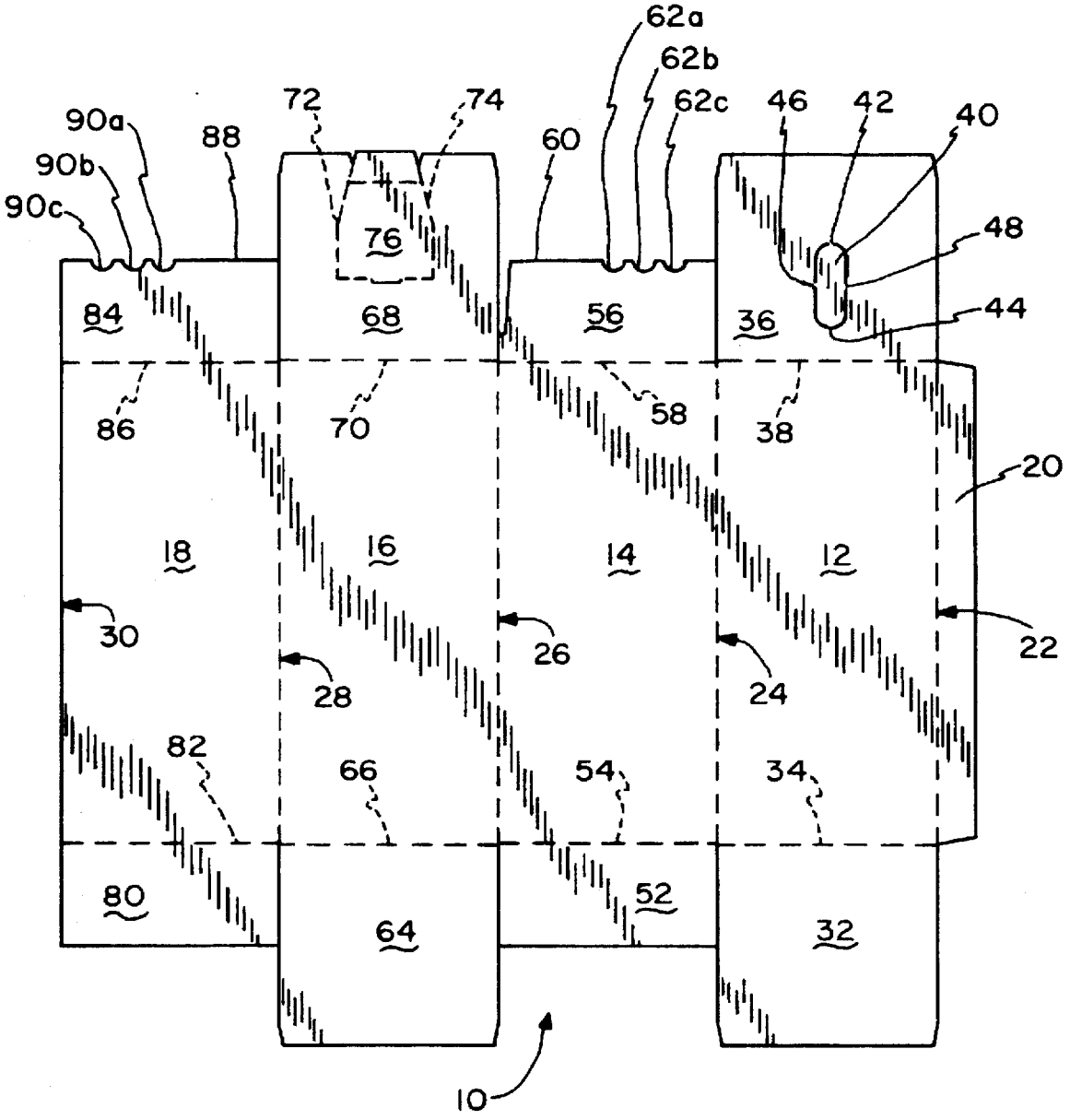
FIG. 1 is a top view of a blank used to form a container having a reclosable shaker pour spout for dispensing granular products according to one embodiment of the invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a blank from which a container having a reclosable shaker pour spout for dispensing granular products according to one embodiment of the invention is illustrated and generally designated by a reference numeral 10. While the foregoing description of the blank 10 will be made with reference to the specific dimensions and shapes depicted in FIG. 1, it should be appreciated that the blank 10 may be varied according to the level of ordinary skill in the art to produce containers having other dimensions and shapes still falling within the scope of the invention.

The blank 10 is comprised of four consecutively joined rectangular side panels 12, 14, 16 and 18. The first side panel 12 has a glue flap 20 hingedly attached to its outer edge along a first pre-break score line 22. The glue flap 20 may be attached to the fourth side panel 18 instead of the first side panel 12. The second side panel 14 is hingedly attached to the first side panel 12 along a first working score line 24. The third side panel 16 is hingedly attached to the second side panel 14 along a second pre-break score line 26. The fourth side panel 18 is hingedly attached to the third side panel 16 along a second working score line 28. The fourth side panel 18 has a free outer edge 30. The side panels 12, 14, 16 and 18 have equal widths so that the folded container will have a square cross section, but it should be appreciated that the the widths of side panels may be varied to form containers having alternative cross sectional shapes.

A first-down bottom major flap 32 is hingedly connected to a bottom edge 34 of the first side panel 12, and a first-down top major flap 36 is hingedly connected to a top edge 38 of the first side panel 12. Both the first-down bottom major flap 32 and the first-down top major flap 36 have a generally square shape with a width equal to that of the side panels 12, 14, 16 and 18, but again their shape as well as all other flaps hereinafter described may be varied according to the level of ordinary skill in the art. The surface of the first-down top major flap 36 is cut to define a detachable die-cut plug 40 having an elongated shape oriented generally perpendicular to the top edge 38 of the first side panel 12. The outer surface of the detachable die-cut plug 40 remains attached to the surface of the first-down top major flap 36 along four breakable nicks 42, 44, 46 and 48 spaced equidistantly about the perimeter of the plug 40. As will be described in greater detail hereinafter, the plug 40 is adapted to be detached from the first-down top major flap 36 upon breaking of the nicks 42, 44, 46 and 48, leaving an orifice 50 (not shown) on the first-down major flap 36 in the position formerly occupied by the plug 40.

A first bottom minor flap 52 is hingedly connected to a bottom edge 54 of the second side panel 14, and a first top minor flap 56 is hingedly connected to a top edge 58 of the second side panel 14. Both the first bottom minor flap 52 and the first top minor flap 56 have a width equal to that of the second side panel 14. The first top minor flap 56 has a generally linear outer edge 60 with portions cut away therefrom to define a series of semi-apertures 62 on the outer edge 60. Although three semi-apertures **62*a*, 62*b* and 62*c* having the general shape of a semi-circle are depicted in FIG. 1, the number and shape of the semi-apertures 62 may be varied as desired in other embodiments of the invention. As will be hereinafter described in more detail, the outer edge 60 and semi-apertures 62 on the first top minor flap 56** are adapted to be joined to corresponding elements aligned on a second top minor flap to define an interface with complete apertures.

A second-down bottom major flap 64 is hingedly connected to a bottom edge 66 of the third side panel 16, and a second-down top major flap 68 is hingedly connected to a top edge 70 of the third side panel 16. Two opposing tear lines 72 and 74 are formed on the second-down top major flap 68 to define the edges of a tear-away pour spout opening tab 76. The tear lines 72 and 74 each contain a series of several small breakaway elements which break along the tear lines 72 and 74 in response to the opening tab 76 being pulled away from the second-down top major flap 68. The tear lines 72 and 74 may alternatively consist of perforations or reverse cuts along the second-down top major flap in accordance with the level of ordinary skill in the art.

A second bottom minor flap 80 is hingedly connected to a bottom edge 82 of the fourth side panel 18, and a second top minor flap 84 is hingedly connected to a top edge 86 of the fourth side panel. The second top minor flap 84 has a generally linear outer edge 88 with portions cut away therefrom to define a series of semi-apertures 90*a*, 90*b* and 90*c* on the outer edge 88 which are adapted to cooperate with the semi-apertures 62*a*, 62*b* and 62*c*, respectively, on the outer edge 60 of the first top minor flap 56.

Figure 2:
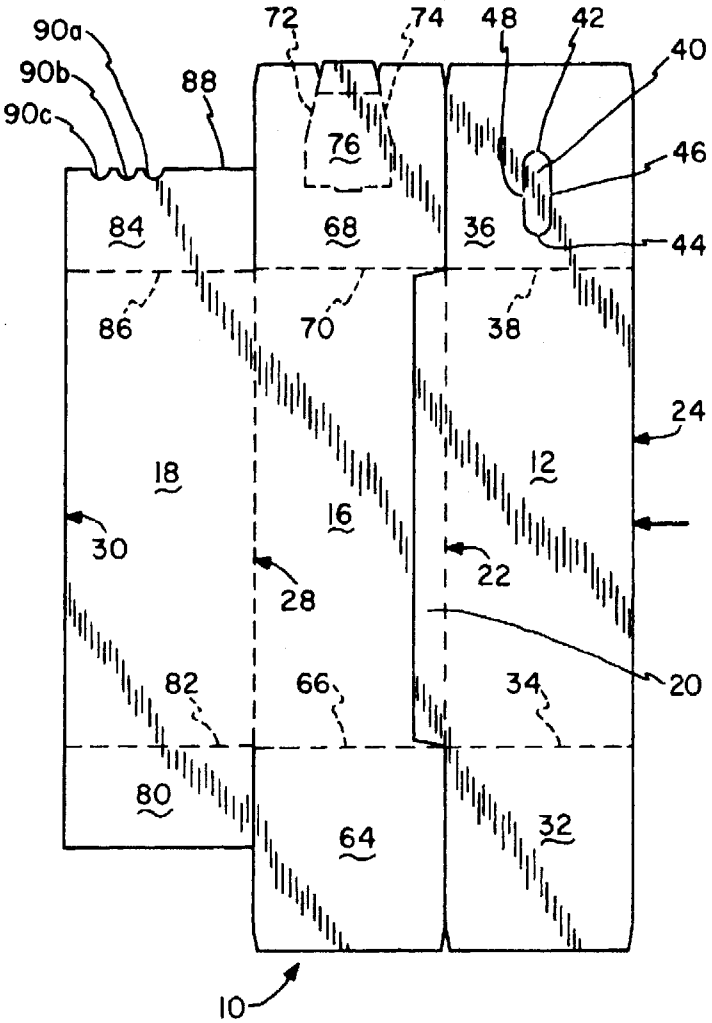
FIG. 2 is a top view of the blank depicted in FIG. 1 after a first folding step has been performed.

Turning now to FIGS. 2–8, the steps required to transform the blank of FIG. 1 into a completed container having a reclosable pour spout will hereinafter be described. As depicted in FIG. 2, a first folding step entails folding the first side panel 12 inwardly toward the second side panel 14 along the first working score line 24. As a result of the first folding step, the first side panel 12 lies flatly on top of the surface of the second side panel 14 and the glue flap 20 extends over the third side panel 16. Glue or any other suitable adhesive substance known in the art is applied to the outer surface of the glue flap 20. Preferably, glue is applied to the glue flap 20 before the first folding step is performed, but it should be appreciated that glue may be applied at any convenient step in the process of forming the container.

Figure 3:
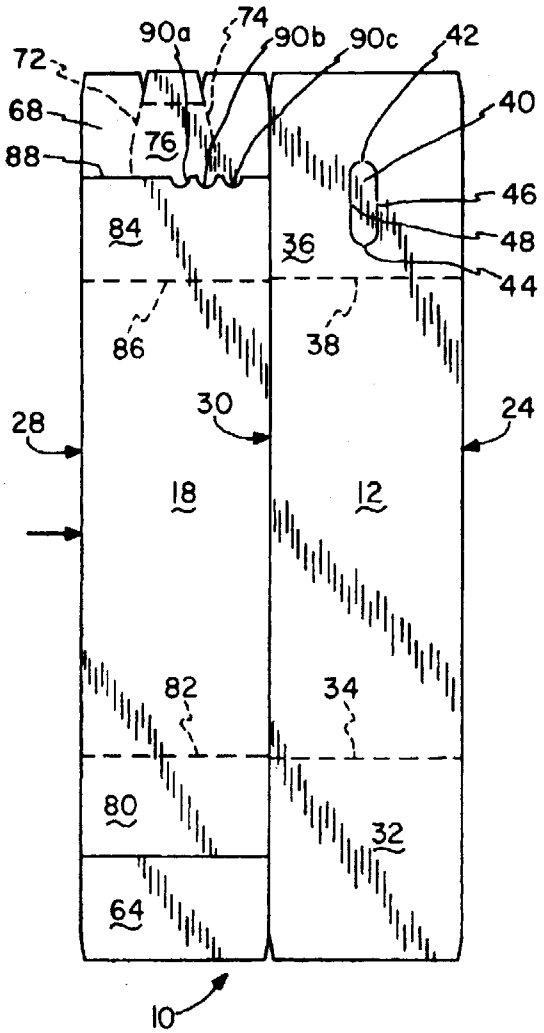
FIG. 3 is a top view of the blank depicted in FIG. 1 after a second folding step has been performed.

Referring now to FIG. 3, a second folding step is performed wherein the fourth side panel 18 is folded inwardly toward the third side panel 16 along the second working score line 28. As a result of the second folding step, the fourth side panel 18 lies flatly on top of the surface of the third side panel 16 and the glue flap 20, causing the portion of the fourth side panel 18 that overlies the glue flap 20 to become adhered to the glue flap 20.

Figure 5:
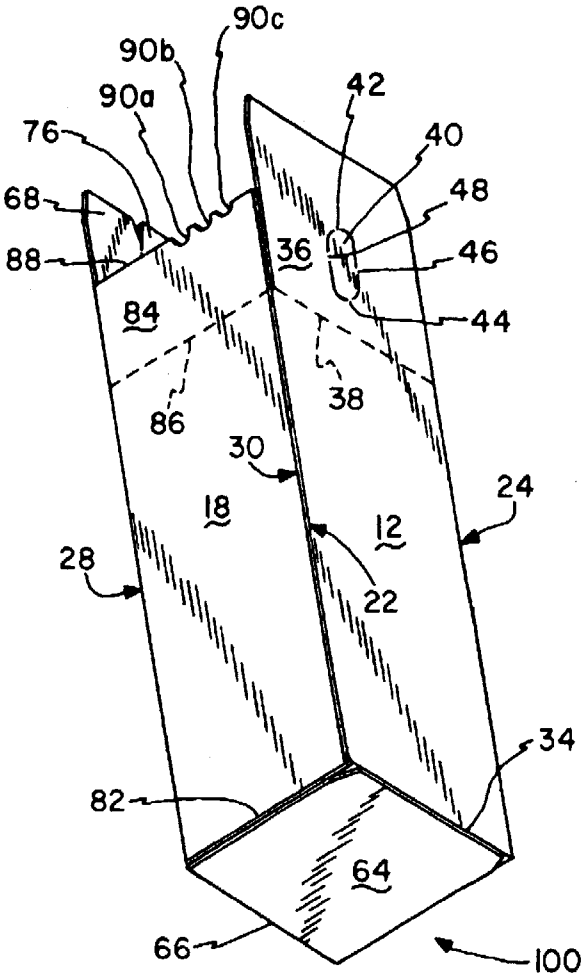
FIG. 5 is a perspective view depicting the container of FIG. 4 after the bottom flaps have been folded inward.
Figure 4:
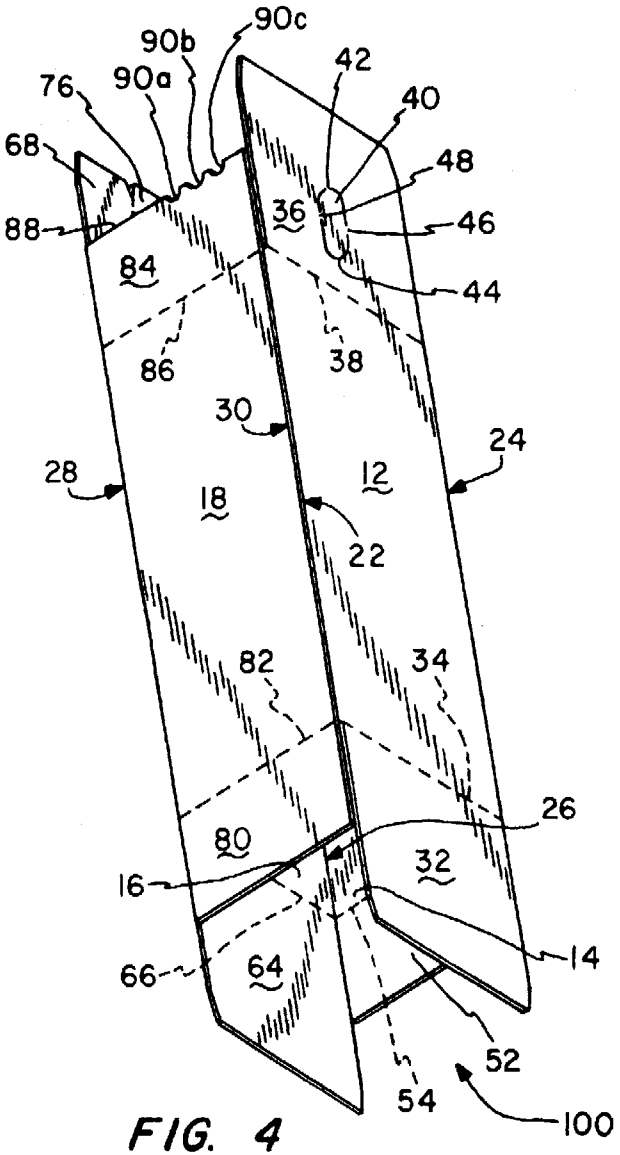
FIG. 4 is a perspective view illustrating the initial post-break appearance of the container according to one embodiment of the invention.

As shown in FIG. 4, the folded blank 10 is then erected or "broken" open by any suitable method such that the side panels 12, 14, 16 and 18 form the walls of a container 100 having a square or rectangular cross section. Next, as depicted in FIG. 5, the bottom of container 100 is closed by inwardly folding the first and second bottom minor flaps 52 and 80, followed by the first and second-down bottom major flaps 32 and 64, respectively.

Formation of the top of container 100 is begun by folding the first and second top minor flaps 56 and 84 inwardly. In the embodiment shown in FIG. 6, this step results in the outer edge 60 of the first top minor flap 56 meeting and abutting the outer edge 88 of the second top minor flap 84, causing semi-apertures 62*a*, 62*b* and 62*c* of the first top minor flap 56 becoming adjacent to the semi-apertures 90*a*, 90*b* and 90*c* of the second top minor flap 84 and thereby forming full apertures 92, 94 and 96. Of course, the number, size and shape of the apertures 92, 94 and 96 are dependent on the number, size and shape of adjacent semi-apertures 62*a* and 90*a*, 62*b* and 90*b* and 62*c* and 90*c* but otherwise may be formed in virtually any number, size or shape, including very small sizes adapted for dispensing fine granular particles. Additionally, it should be appreciated that the outer edges 60 and 88 of the first and second top minor flaps 56 and 84 do not need to directly abut each other, but rather may overlap or be spaced apart by a small distance as long as their respective semi-apertures cooperate to form resulting apertures 92, 94 and 96 adapted to dispense granular particles. This method of forming apertures thereby provides an important advantage over the prior art because it permits the formation of very small apertures and eliminates the punching and stripping problems associated with prior art pour spout containers.

Figure 7:
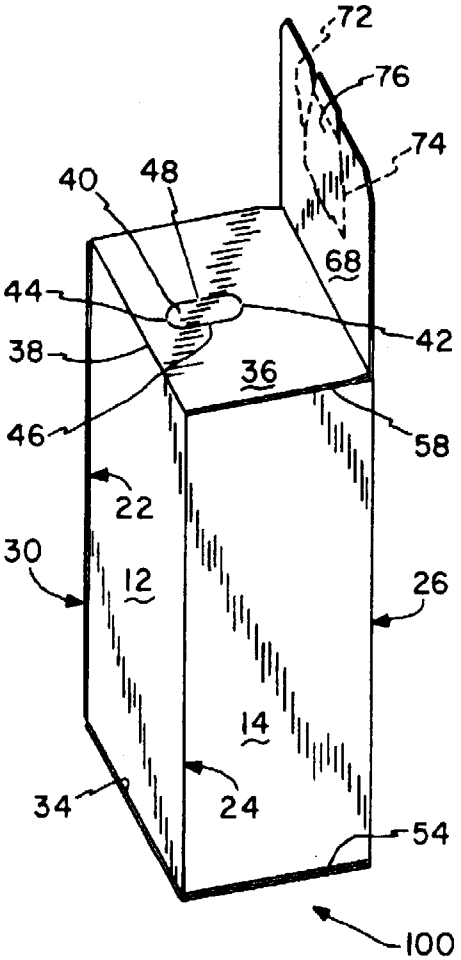
FIG. 7 is a perspective view depicting the container of FIG. 6 after the first-down top major flap has been folded inward.
Figure 6:
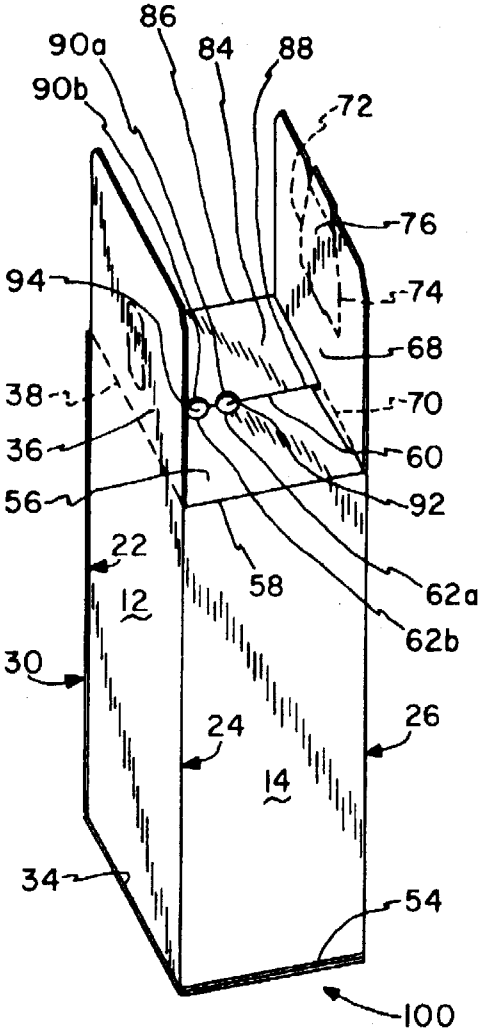
FIG. 6 is a perspective view depicting the container of FIG. 5 after the top minor flaps have been folded inward.

As shown in FIG. 7, formation of the top of the container 100 next requires folding down the first-down top major flap 36 over the first and second top minor flaps 56 and 84. As a result of this folding step, the detachable die-cut plug 40 overlies the apertures 92, 94 and 96 formed along the outer edges 60 and 88 of the first and second top minor flaps 56 and 84. Glue or any other suitable adhesive substance known in the art is then applied to the outer surface of the detachable die-cut plug 40.

Figure 8:
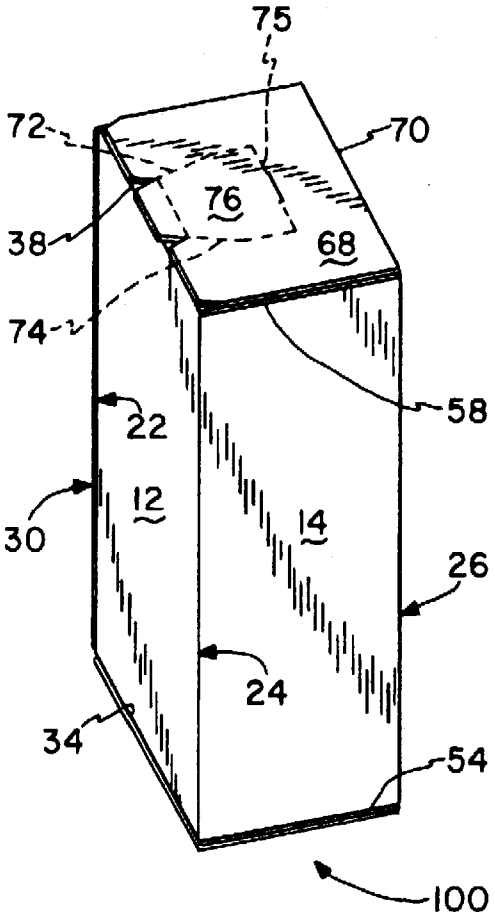
FIG. 8 is a perspective view depicting the container of FIG. 7 after the second-down top major flap has been folded inward.

Next, as depicted in FIG. 8, the second-down top major flap 68 is folded inwardly over the first-down top major flap 36 to form the top of container 100. As a result of this step, the detachable die-cut plug 40 becomes adhered to the bottom surface of the pour spout opening tab 76 on the second-down top major flap 68.

Figure 9:
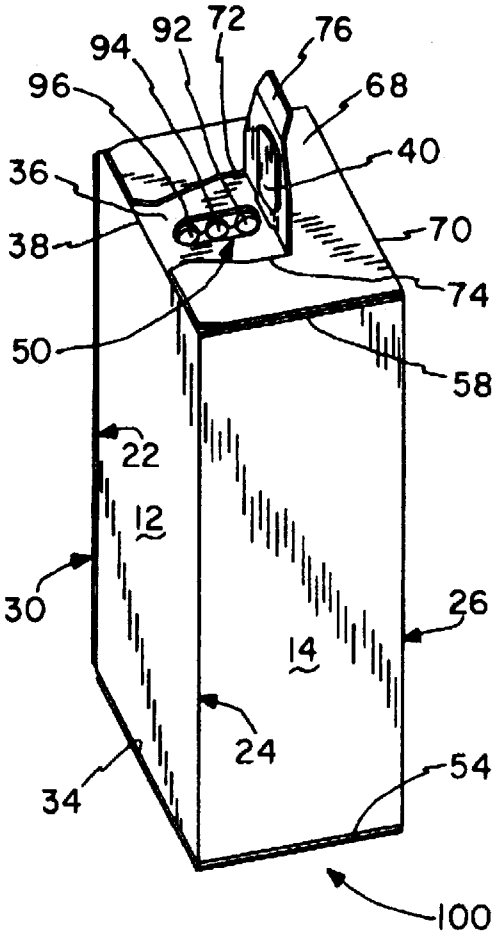
FIG. 9 is a perspective view depicting the container of FIG. 8 after the pour spout opening tab has been opened.

As shown in FIG. 9, the container 100 may thereby be opened by pulling pour spout opening tab 76 outward, causing the edges of the pour spout opening tab 76 to break free from the second-down top major flap along tear lines 72 and 74. The opening tab 76 thereafter remains attached to the second-down top major flap 68 along a hinged rear edge 75. The detachable die-cut plug remains adhered to the bottom surface of the opening tab and becomes detached from the first-down top major flap in response to the initial opening of the container. Thereafter, the container becomes reclosable by means of the detachable plug becoming frictionally engaged within the opening in the first-down top major flap formed by its initial removal. Because the detachable die-cut plug 40 remains adhered to the bottom surface of the pour spout opening tab 76, opening of the container also causes the detachable die-cut plug 40 to become detached from the first-down top major flap 36. An orifice 50 is thereby formed in the position formerly occupied by the plug 40, under which can be seen the outlet apertures 92, 94 and 96 of the container. The container 100 may thereafter be reclosed by simply pushing the pour spout opening tab 76 downward such that the die-cut plug 40 becomes frictionally engaged within the orifice 50.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container having a reclosable shaker pour spout for dispensing granular products, said container comprising:

a plurality of side panels hingedly connected along transverse fold lines and folded relative to each other to form a first and second pair of opposing sides of said container;

a plurality of bottom flaps hingedly connected to bottom edges of said side panels and folded inwardly from said opposing sides to form the bottom of said container;

first and second top minor flaps hingedly connected to top edges of one of said first and second pair of opposing sides, said first and second top minor flaps having outer edges defining a plurality of semi-apertures on one of said outer edges and a corresponding plurality of semi-apertures on the other of said outer edges, said semi-apertures being aligned along said first and second top minor flaps, said first and second top minor flaps being folded inwardly toward each other such that said outer edges generally meet to define an interface and said plurality of semi-apertures on each of said outer edges generally meet to define a corresponding plurality of apertures along said interface; and a pair of top major flaps hingedly connected to top edges of the other of said first and second pair of opposing sides and folded inwardly over said top minor flaps, said pair of top major flaps including a first-down top major flap and a second-down top major flap, said first-down top major flap including a detachable plug, said first-down top major flap overlapping said first and second top minor flaps such that said detachable plug overlays said plurality of apertures, said second-down top major flap including a tear-away pour spout opening tab, said second-down top major flap folded over said first-down top major flap such that a bottom surface of said opening tab is adhered to said detachable plug, said opening tab being adapted to be torn away from said second-down top major flap, said detachable plug remaining adhered to said bottom surface of said opening tab and becoming detached entirely from said first-down top major flap in response to said opening tab being torn away from said second-down top major flap, said detachable plug thereafter being frictionally engagable within an opening of said first-down top major flap formed by removal of said detachable plug.

2. The container of claim 1 wherein the container is composed of a unitary blank of paperboard material.

3. The container of claim 1 wherein each of said plurality of apertures has a circular perimeter.

4. The container of claim 1 wherein each of said plurality of apertures is small so as to permit dispensation of fine granular products.

5. In a container for dispensing granular products having a plurality of flaps for forming a wall of said container, said plurality of flaps including a first and second minor flap, a first-down major flap, and a second-down major flap, said first and second minor flaps being folded inwardly, said first-down major flap being folded inwardly and overlying said first and second minor flaps, said second-down major flap being folded inwardly and overlying said first-down major flap, a reclosable shaker pour spout comprising:

a plurality of semi-apertures formed on an outer edge of each of said first and second minor flaps, said semi-apertures being aligned along said first and second minor flaps, said outer edges generally meeting to define an interface in response to said first and second minor flaps being folded inwardly, said plurality of semi-apertures on each of said outer edges generally meeting to define a corresponding plurality of apertures along said interface;

a detachable plug formed on a surface of said first-down major flap and overlying said plurality of apertures in response to said first-down major flap being folded inwardly; and a tear-away pour spout opening tab formed on said second-down major flap, said opening tab having a bottom surface adhered to said detachable plug in response to said second-down major flap being folded inwardly, said opening tab being adapted to be torn away from said second-down major flap, said detachable plug remaining adhered to said bottom surface of said opening tab and becoming detached entirely from said first-down major flap in response to said opening tab being torn away from said second-down major flap, said detachable plug thereafter becoming frictionally engagable within an opening of said first-down major flap formed by removal of said detachable plug.

6. The pour spout of claim 5 wherein said container is composed of a unitary blank of paperboard material.

7. The pour spout of claim 5 wherein each of said plurality of apertures has a circular perimeter.

8. The pour spout of claim 5 wherein each of said plurality of apertures is small so as to permit dispensation of fine granular products.

9. In a container for dispensing granular products, a pour-spout-forming wall comprising:

first and second minor flaps having outer edges defining a plurality of semi-apertures on one of said outer edges and a corresponding plurality of semi-apertures on the other of said outer edges, said plurality of semi-apertures being aligned along said first and second minor flaps, said first and second minor flaps being folded inwardly toward each other such that said outer edges generally meet to define an interface and said plurality of semi-apertures on each of said outer edges generally meet to define a plurality of apertures along said interface;

a first-down major flap having a detachable plug overlapping said first and second top minor flaps such that said detachable plug overlays at least one of said plurality of apertures; and a second-down major flap having a tear-away pour spout opening tab overlapping said first-down major flap such that a bottom surface of said opening tab is adhered to said detachable plug, said opening tab being adapted to be torn away from said second-down major flap, said detachable plug remaining adhered to said bottom surface of said opening tab and becoming detached entirely from said first-down major flap in response to said opening tab being torn away from said second-down major flap, said detachable plug thereafter being frictionally engagable within an opening of said first-down major flap formed by removal of said detachable plug.

10. A unitary blank of paperboard material adapted to be formed into a container having a reclosable shaker pour spout for dispensing granular products, comprising:

four consecutively joined side panels, a first and second of said four side panels hingedly attached to each other along a first score line, a third of said four side panels hingedly attached to said second side panel along a second score line, a fourth of said four side panels hingedly attached to said third side panel along a third score line;

a glue flap hingedly attached to an outer edge of one of said first side panel and said fourth side panel;

a first-down bottom major flap hingedly connected to a bottom edge of said first side panel;

a first-down top major flap hingedly connected to a top edge of said first side panel and including a detachable plug;

a first bottom minor flap hingedly connected to a bottom edge of said second side panel;

a first top minor flap hingedly connected to a top edge of said second side panel including an outer edge defining a plurality of semi-apertures;

a second-down bottom major flap hingedly connected to a bottom edge of said third side panel;

a second-down top major flap hingedly connected to a top edge of said third side panel and including a tear-away pour spout opening tab;

a second bottom minor flap hingedly connected to a bottom edge of said fourth side panel; and a second top minor flap hingedly connected to a top edge of said fourth side panel and having an outer edge defining a plurality of semi-apertures.

11. In a container for dispensing granular products having a plurality of flaps for forming a wall of said container, said plurality of flaps including a first and second minor flap, a first-down major flap, and a second-down major flap, said first and second minor flaps being folded inwardly, said first-down major flap being folded inwardly and overlying said first and second minor flaps, said second-down major flap being folded inwardly and overlying said first-down major flap, a method of forming a reclosable shaker pour spout comprising the steps of:

cutting away portions of an outer edge of one of said first and second minor flaps to form a first plurality of semi-apertures;

cutting away portions of an outer edge of the other of said first and second minor flaps to form a second plurality of semi-apertures;

cutting through portions of a surface of said first-down major flap to form a detachable plug;

cutting through portions of a surface of said second-down major flap to form two opposing tear lines defining a tear-away pour spout opening tab;

inwardly folding said first and second minor flaps such that said outer edges generally meet to define an interface and said first plurality of semi-apertures generally aligns with said second plurality of semi-apertures to define a plurality of apertures along said interface;

inwardly folding said first-down major flap over said first and second minor flaps so that said detachable plug overlays said plurality of apertures; and inwardly folding said second-down major flap over said first-down major flap such that a bottom surface of said opening tab is adhered to said detachable plug.

12. The method of claim 11 further including the step of initially opening said container by tearing said opening tab away from said second-down top major flap along said tear lines, said step of tearing said opening tab causing said detachable plug to remain adhered to said bottom surface of said opening tab and become detached entirely from said first-down top major flap.

13. The method of claim 12 further including the step of closing said container by frictionally engaging said detachable plug within an opening of said first-down top major flap formed by removal of said detachable plug.

14. The method of claim 13 further including the steps of re-opening and re-closing said container by lifting and depressing said opening tab, said step of lifting said opening tab causing said detachable plug to become disengaged from said opening, said step of depressing said opening tab causing said detachable plug to become re-engaged within said opening.

* * * * *